US008540356B2

(12) United States Patent
Nishimura et al.

(10) Patent No.: US 8,540,356 B2
(45) Date of Patent: Sep. 24, 2013

(54) PRINTING MACHINE

(75) Inventors: Asayo Nishimura, Ibaraki-ken (JP); Hiroshi Sugitani, Ibaraki-ken (JP); Akiko Hayashi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 312 days.

(21) Appl. No.: 12/891,009

(22) Filed: Sep. 27, 2010

(65) Prior Publication Data

US 2011/0074840 A1 Mar. 31, 2011

(30) Foreign Application Priority Data

Sep. 28, 2009 (JP) ..... P2009-222918
Sep. 22, 2010 (JP) ..... P2010-212553

(51) Int. Cl.
*B41J 2/19* (2006.01)
*B41J 29/38* (2006.01)

(52) U.S. Cl.
USPC ..... 347/92; 347/6

(58) Field of Classification Search
None
See application file for complete search history.

(56) References Cited

U.S. PATENT DOCUMENTS

2008/0079759 A1* 4/2008 Nagashima ..... 347/10

FOREIGN PATENT DOCUMENTS

JP 2007-190703 A 8/2007

* cited by examiner

*Primary Examiner* — Geoffrey Mruk
(74) *Attorney, Agent, or Firm* — Nath, Goldberg & Meyer; Jerald L. Meyer

(57) ABSTRACT

A duplex printing machine 1 includes an inkjet head 27 with a piezoelectric element set for vibrations to propel out droplets of aqueous ink 50, an inkbottle 21 for supplying aqueous ink 50 to the inkjet head 27, a system of ink lines 28 having a lower tank 22, a circulation pump 23, a filter 25, and an upper tank 26, a degasser 24 having a degassing pump 24*a* for degassing flux of aqueous ink 50 being to be supplied to the inkjet head 27, and a controller 7 operable to control the degassing pump 24*a*, the controller 7 being adapted to operate, as a print time calculated from an image data set of a print job is equal to or greater than a prescribed value, for driving the degassing pump 24*a* to degas flux of aqueous ink 50.

8 Claims, 6 Drawing Sheets

Tb1

| INK TEMPERATURES | PRINT TIME THRESHOLDS |
|---|---|
| $T_1 \sim T_2$ | $Th_1$ |
| $T_2 \sim T_3$ | $Th_2$ |
| $T_3 \sim T_4$ | $Th_3$ |
| $T_4 \sim T_5$ | $Th_4$ |

Tb2

| VIBRATION CYCLES | PRINT TIME THRESHOLDS |
|---|---|
| $f_1 \sim f_2$ | $Th_1$ |
| $f_2 \sim f_3$ | $Th_2$ |
| $f_3 \sim f_4$ | $Th_3$ |
| | $Th_4$ |

Tb3

| | | VIBRATION CYCLES | | |
|---|---|---|---|---|
| | | $f_1 \sim f_2$ | $f_2 \sim f_3$ | $f_3 \sim f_4$ |
| INK TEMPERATURES | $T_1 \sim T_2$ | $Th_1$ | $Th_6$ | $Th_{12}$ |
| | $T_2 \sim T_3$ | $Th_2$ | $Th_7$ | $Th_{13}$ |
| | $T_3 \sim T_4$ | $Th_3$ | $Th_8$ | $Th_{14}$ |
| | $T_4 \sim T_5$ | $Th_4$ | $Th_9$ | $Th_{15}$ |
| | $T_5 \sim T_6$ | $Th_5$ | $Th_{10}$ | $Th_{16}$ |

$Th_n (n=1,2,\cdots)$ : PRINT TIME THRESHOLD

PRINTING MACHINE

BACKGROUND OF THE INVENTION

1. Field of the Invention

The present invention relates to a printing machine including an ink supply that has a degasser.

2. Description of Related Art

There are known printing machines provided with an inkjet head for propelling out ink droplets, and an ink supply as a measure for supplying ink to the inkjet head. In such printing machines, the inkjet head has a set of piezoelectric elements or like elements exerting pressures on flux of ink, when printing images. This propels out droplets of ink onto a print sheet or such, to make the printing.

In such printing machines, ink contains dissolved gases that, if contained much, have tendencies to form bubbles depending on ink temperature and pressure variations while printing. Formed bubbles may absorb substantial pressures exerted on associated flux of ink, resulting in a failure to discharge ink, as an issue. To this point, there are known printing machines including a degasser for reducing contents of gases dissolved in ink.

There has been an inkjet printing machine disclosed in Japanese Patent Application Laying-Open Publication No. 2007-190703, including an ink circulation system for circulating ink, a dissolved gas amount acquirer for acquiring information on an amount of dissolved gases in ink, a three-way valve installed on an ink line in the ink circulation system for route selection among branched ink routes, a degasser installed on one of the ink routes branched at the three-way valve, and a pressure loss compensator for compensating a pressure of ink caused by the degasser.

This printing machine has been adapted to work after initiation of a printing, to operate upon a determination made on an excessive amount of gases dissolved in ink, to control the three-way valve, to conduct flux of ink through the ink route having the degasser installed thereon. This has afforded to supply flux of degassed ink to an inkjet head, there being a pressure loss caused in flux ink flowing through the degasser. The pressure loss compensator has been operated to make a pressure adjustment of such flux of ink.

SUMMARY OF THE INVENTION

However, the printing machine described has employed a method of following an initiation of a printing to determine a degassing to be made or not, sometimes leading to a delayed initiation of the degassing after a determination on an excessive amount of dissolved gases in ink, resulting in a failure in discharge of ink, as an issue.

The present invention has been devised in view of such issues. It therefore is an object of the present invention to provide a printing machine allowing for a suppressed failure in discharge of ink due to the delay of degassing.

To achieve the object described, according to an aspect of the present invention, there is a printing machine comprising an inkjet head including a piezoelectric element set configured to vibrate to propel out droplets of ink, a degasser configured to degas flux of ink to be supplied to the inkjet head, a memory configured to store therein a threshold table having mutually associated a threshold set of a determination parameter preset for a determination on a degassing process and a domain set of a control parameter of a physical amount constituting a cause of bubble formation in ink, and a controller configured to control driving the degasser, the controller being adapted to calculate a value of the determination parameter from a set of image data of a print job, and operate as the value is equal to or greater than a threshold in the threshold table read out of the memory, to drive the degasser.

DESCRIPTION OF EMBODIMENTS

First Embodiment

There will be described an aqueous ink addressing inkjet type duplex printing machine according to a first embodiment of the present invention, with reference to the drawings. As used herein, the aqueous ink involves the concept of a moisture containing ink encompassing an O/W (Oil in Water) type and a W/O (Water in Oil) type emulsion ink.

Figure 1:
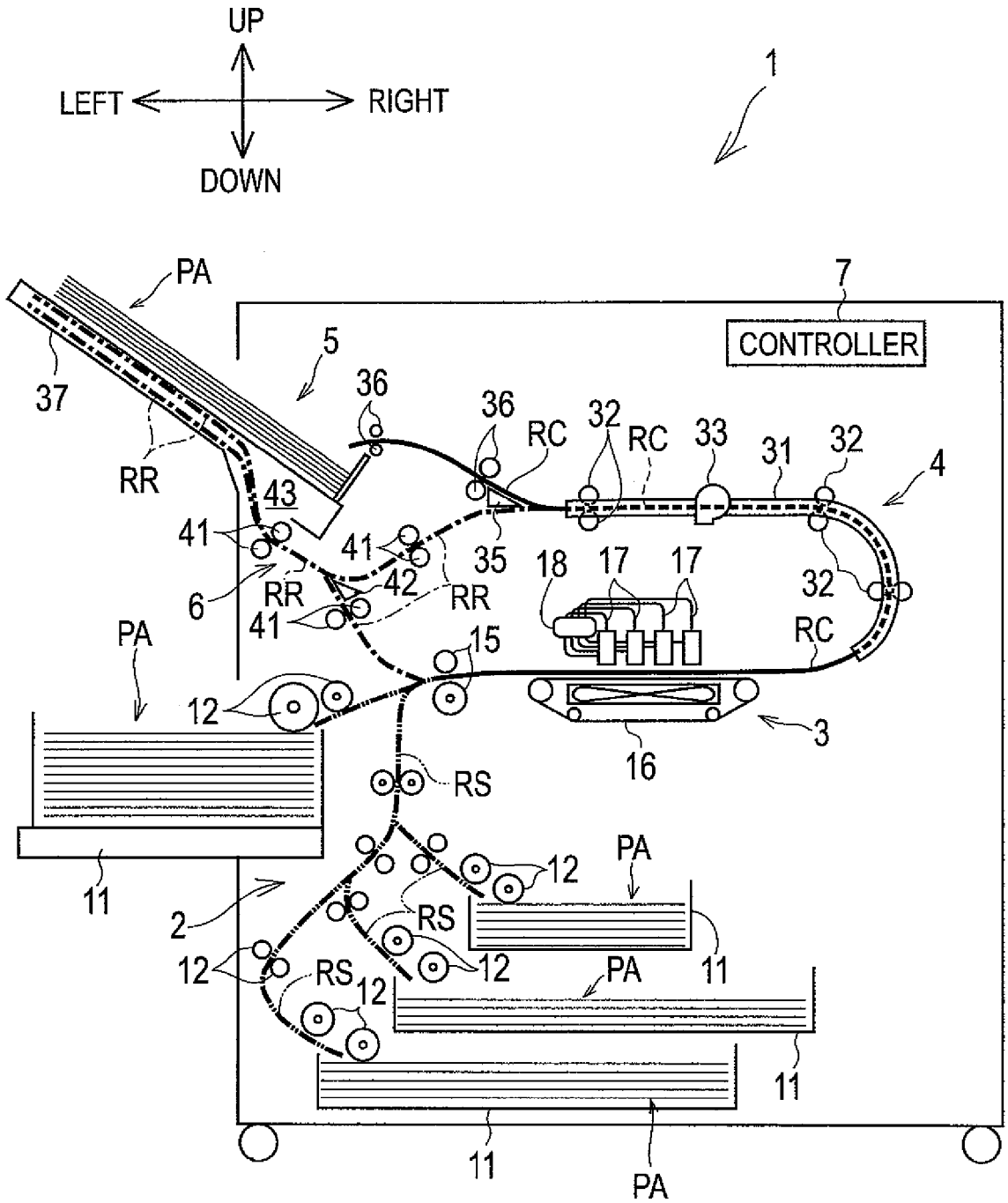
FIG. 1 is an overall schematic diagram of a duplex printing machine according to a first embodiment.
Figure 2:
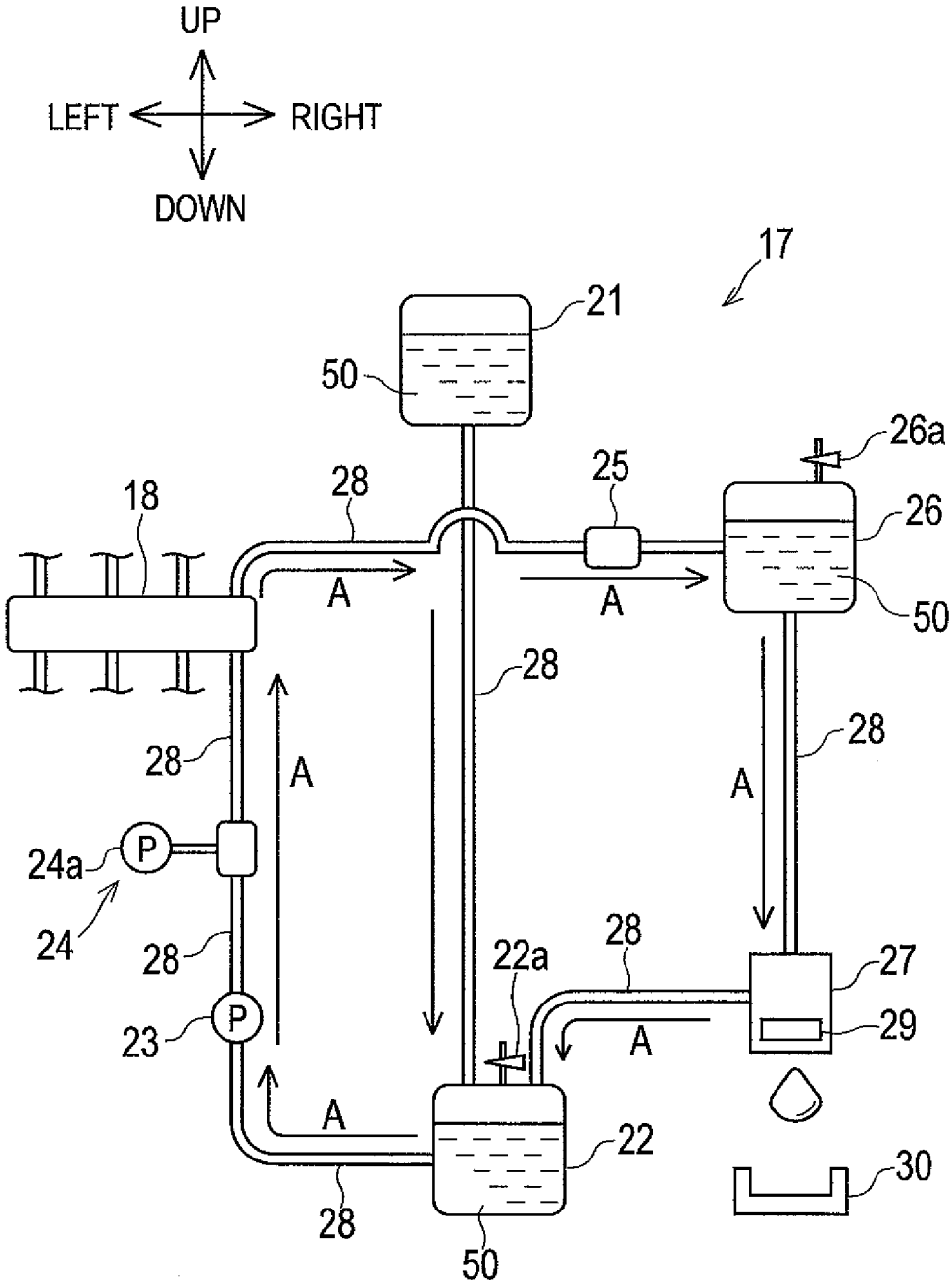
FIG. 2 is a schematic diagram of an ink circulation system of the duplex printing machine shown in FIG. 1.
Figures 3, 4:
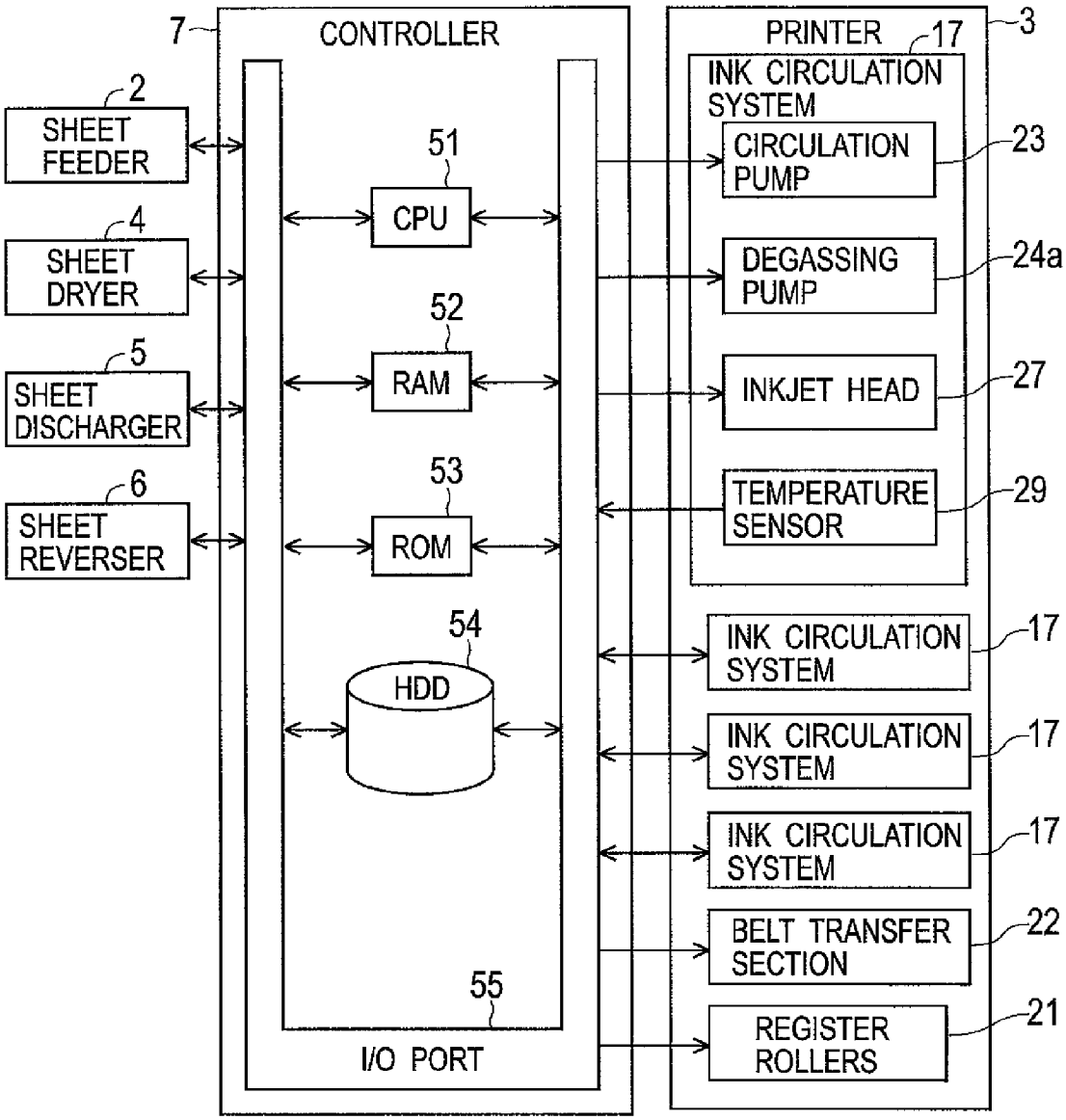
FIG. 3 is an explanatory block diagram of a control system of the duplex printing machine shown in FIG. 1.
FIG. 4 is an example of threshold table listing print time thresholds associated with ink temperatures.

FIG. 1 is an overall schematic diagram of the duplex printing machine according to the first embodiment. FIG. 2 is a schematic diagram of an ink circulation system. FIG. 3 is an explanatory block diagram of a control system of the duplex printing machine. FIG. 4 is an example of threshold table listing print time thresholds associated with ink temperatures. The following description presumes a user standing at an obverse sheet side as a front side of FIG. 1, having upward, downward, rightward, and leftward directions marked in FIG. 1 in consistent with upward, downward, rightward, and leftward directions seen from the user, respectively.

In FIG. 1, those paths depicted by bold lines are mutes of a transfer system adapted for transfer of print sheets. Among the transfer routes, those depicted by solid lines and dashed lines constitute a normal route RC. Among the transfer routes, those depicted by chain lines constitute a reversing route RR. Among the transfer routes, those depicted by two-dot chain lines constitute a system of feed routes RS.

As illustrated in FIG. 1, the duplex printing machine 1 includes a sheet feeder 2, a printer 3, a sheet dryer 4, a sheet discharger 5, a sheet reverser 6, and a controller 7.

The sheet feeder 2 is configured to feed a print sheet PA. The sheet feeder 2 constitutes an upstream end of the transfer system. The sheet feeder 2 includes a set of feed racks 11, and a set of pairs of feed rollers 12. Paired feed rollers 12 work to transfer a print sheet PA from any feed rack 11, along a feed route RS to the printer 3.

The printer 3 is configured to transfer a print sheet PA, printing images on the print sheet PA. The printer 3 is disposed downstream of the sheet feeder 2. The printer 3 includes a pair of register rollers 15, a belt transfer section 16, a combination of four ink circulation systems 17, and a heat exchanger 18.

The pair of register rollers 15 works to transfer a print sheet PA fed from the sheet feeder 2 or the sheet reverser 6, to the belt transfer section 16. The belt transfer section 16 is configured to hold thereon by sucking a print sheet PA sent thereover from register rollers 15, to transfer to the sheet dryer 4.

Four ink circulation systems 17 are each configured to circulate a supplied aqueous ink 50 in one direction of a circulation loop, propelling out droplets of aqueous ink 50 as necessary to print images. The ink circulation systems 17 circulate different colors (e.g. black, cyan, magenta, and yellow) of aqueous ink 50, respectively.

As illustrated in FIG. 2, each ink circulation system 17 includes an inkbottle 21, a lower tank 22, a circulation pump 23, a degasser 24, a filter 25, an upper tank 26, and an inkjet head 27 provided with a temperature sensor 29, and a cap 30, as well as a number of tube lines 28 constituting flow paths for aqueous ink 50. There is an ink supply configured with the inkbottle 21, the lower tank 22, the circulation pump 23, the filter 25, the upper tank 26, and associated ink lines 28.

The inkbottle 21 serves for storage of aqueous ink 50 to be supplied.

The lower tank 22 is configured for temporary storage of aqueous ink 50 supplied from the inkbottle 21 through an ink line 28. The lower tank 22 is adapted for temporary storage of aqueous ink 50 returned from the inkjet head 27 through an ink line 28. The lower tank 22 is disposed lower than both the upper tank 26 and the inkjet head 27. The lower tank 22 has a relief valve 22*a* operable to relieve an inner pressure to the atmosphere.

The circulation pump 23 is adapted to send flux of aqueous ink 50 from the lower tank 22, where it has been stored, to the upper tank 26 through associated ink lines 28. This causes flux of aqueous ink 50 to flow in a flow direction along the circulation route shown by arrows A in FIG. 2, for the supply to the inkjet head 27.

The degasser 24 is configured for degassing flux of aqueous ink 50 being supplied to the inkjet head 27, to remove dissolved gases therein. The degasser 24 has a degassing pump 24*a*. With such configuration, the degasser 24 is adapted to have part of the ink circulation route pressure-reduced for degassing aqueous ink.

The filter 25 serves to remove lint or the like in flux of aqueous ink 50.

The upper tank 26 is configured for temporary storage of aqueous ink 50 before the supply to the inkjet head 27. The upper tank 26 is filled with a combination of aqueous ink 50 and air. The upper tank 26 is adapted to supply flux of aqueous ink 50 that has been stored therein, to the inkjet head 27 through an ink line 28. The upper tank 26 has a relief valve 26*a* operable to relieve an inner pressure to the atmosphere.

The inkjet head 27 is configured to propel droplets of aqueous ink 50 onto a print sheet PA, printing images thereon. The inkjet head 27 2 is disposed lower than the upper tank 26. The inkjet head 27 has a set of piezoelectric elements each operable for exertion of pressures to propel out a droplet of aqueous ink 50. During circulation of ink, there is flux of aqueous ink 50 stored in the inkjet head 27, and returned to the lower tank 22 through ink line 28.

The temperature sensor 29 is configured to detect an ink temperature T of flux of aqueous ink 50 in the inkjet head 27. The temperature sensor 29 is adapted to output a detected ink temperature T to the controller 7.

The cap 30 is adapted for sealing a downside of the inkjet head 27. The cap 30 is configured to cover the downside of the inkjet head 27. The cap 30 is displaced to locate in position as shown in FIG. 2 in each course of printing, and to locate close to the downside of inkjet head 27 in each non-printing course.

The heat exchanger 18 is configured to exchange heat between streams of aqueous ink 50 in the four ink circulation routes 17. The heat exchanger 18 serves to average temperatures of four colors of aqueous ink 50.

The sheet dryer 4 is configured to transfer a printed print sheet PA, while drying. The sheet dryer 4 is disposed downstream of the printer 3. The sheet dryer 4 includes a drying duct 31, a triple of pairs of transfer rollers 32, and a heating blower or fan 33.

The drying duct 31 is configured to guide a printed print sheet PA, while accumulating heat of air sent from the heating blower or fan 33. The drying duct 31 has a transfer space (non-depicted) defined therein as part of normal route RC for transfer of print sheet PA. Paired transfer rollers 32 are adapted to transfer the printed print sheet PA in the drying duct 31.

The sheet discharger 5 is configured to discharge a printed print sheet PA in a stacking manner. The sheet discharger 5 is disposed downstream of the sheet dryer 4. The sheet discharger 5 constitutes a downstream end of the normal route RC. The sheet discharger 5 includes a route selector 35, a pair of pairs of discharge rollers 36, and a stacking rack 37.

The route selector 35 is configured to select a transfer route of print sheet PA between the normal route RC and the reversing route RR. Paired discharge rollers 36 are adapted to discharge a print sheet PA onto the stacking rack 37.

The sheet reverser 6 is configured to reverse a one-side printed print sheet PA, to transfer to the printer 3. The sheet reverser 6 includes a set of pairs of reversing rollers 41, a flipper 42, and a switchback section 43.

Some pairs of reversing rollers 41 are cooperative to receive a one-side printed print sheet PA from the sheet dryer 4, once bringing inside the switchback section 43. Some pairs of reversing rollers 41 are cooperative to bring back the print sheet PA outside the switchback section 43, to transfer to the printer 3 through the flipper 42.

The controller 7 is adapted to govern entire control of the duplex printing machine 1. As shown in FIG. 3, the controller 7 includes a CPU 51 configured to execute various programs, a RAM 52 adapted for temporary storage of associated data, a ROM 53 adapted for storage of base programs and the like, an HDD 54 adapted for storage of a printing program, a degassing program, and the like, and an I/O port 55 adapted to implement an I/O interface.

In the HDD 54, as shown in FIG. 4, there is stored a threshold table Tb1 listing a number of domain intervals of ink temperature $\Delta T_n$ (n=1, 2, . . . ) (=$T_1$~$T_2$, $T_2$~$T_3$, $T_3$~$T_4$, . . . ) and a number of thresholds of print time $Th_n$ (n=1, 2, . . . ) related thereto in a one-to-one corresponding manner. According to the first embodiment, the controller 7 is adapted to associate an ink temperature T with a threshold $Th_n$ of print time PT to determine a degassing to be performed or not. This is a criterion introduced for determination in consideration of dissolved gases in ink that: on one hand, become less dissoluble, having increased tendencies to form bubbles, as the ink temperature T increases with accumulated heat dissipation of a set of associated piezoelectric elements, as the piezoelectric element set has an increased total number of vibration cycles N, with a longer print time PT than an associated threshold $Th_n$; and on the other hand, have increased tendencies to form bubbles, as an associated ink chamber has a decreased ink pressure due to vibrations of the piezoelectric element set, with an increased print time TP. In either case, there should be a determination to execute a degassing process or treatment. As used herein, the total vibration cycle number N means a total number of vibration cycles of piezoelectric elements in the inkjet head 27 as necessary to execute a single time of print job, that is, an associated total number of droplets of aqueous ink propelled out of the inkjet head 27. It is noted that in the HDD 54 there is stored a set of thresholds ThV of degas time VT each prepared as a criterion to determine a completion of degassing. In the HDD 54 there is stored a combination of previous print time PTA and print completion time PTE.

The I/O port 55 adapted to work as an I/O interface is connected with the sheet feeder 2, sheet dryer 4, sheet discharger 5, and sheet reverser 6. The I/O port 55 is connected to an external device such as a personal computer (non-depicted) to input image data.

The I/O port 55 is connected to the register rollers 15 and the belt transfer section 16 of the printer 3. The controller 7 is thereby adapted to control a print speed related to the speed of transfer of a certain print sheet PA. The controller 7 is configured to work when degassing, to perform an associated printing by a print speed (referred to as a first print speed) slower than a normal print speed (referred to as a second print speed), before returning to a printing by the normal print speed.

The I/O port 55 is connected with the four ink circulation systems 17. More specifically, the I/O port 55 is connected, in each ink circulation system 17, to its circulation pump 23, degassing pump 24*a*, inkjet head 27, and temperature sensor 29. The controller 7 is thereby adapted to control the circulation pump 23 for circulation of aqueous ink 50.

The controller 7 is configured to work while printing images, to control the degassing pump 24*a* for degassing aqueous ink 50. More specifically, the controller 7 is configured to work for ink temperatures T within an associated ink temperature interval $\Delta T_n$, to operate for print limes PT equal to or longer than an associated print time threshold $Th_n$, for driving the degassing pump 24*a* to degas flux of aqueous ink 50, while printing images. In this regard, the controller 7 is adapted to operate for print times PT shorter than the print time threshold $Th_n$, to print images without driving the degassing pump 24*a*.

The controller 7 is configured to work at a respective timing corresponding to a set of image data to be printed, to send a corresponding set of prescribed ink discharge signals to a driver (non-depicted) at the inkjet head 27. The inkjet head 27 is thereby driven to propel an array of droplets of aqueous ink 50 onto a print sheet PA. It is noted that FIG. 3 has omitted three ink circulation systems 17 out of the four ink circulation systems 17 being common in configuration and connection.

(Printing Process)

Figure 5:
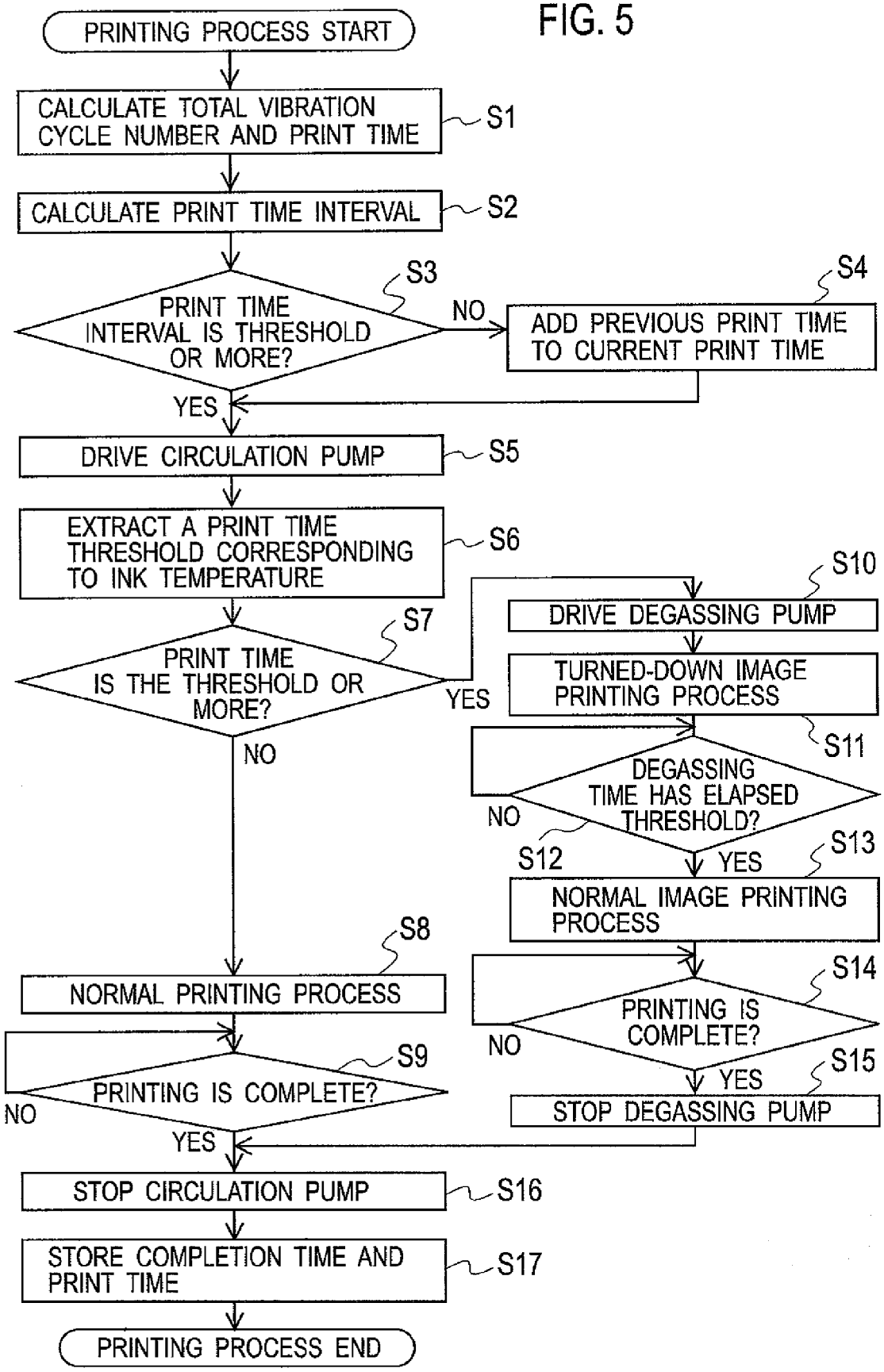
FIG. 5 is an explanatory flowchart of a printing process according to the first embodiment.

Description is now made of printing actions of the duplex printing machine 1 according to the first embodiment. FIG. 5 is an explanatory flowchart of a printing process of the duplex printing machine.

As shown in FIG. 5, first, at a step S1, the controller 7 operates for calculation to determine a total number of vibration cycles N from a set of image data in a current input print job. Further, the controller 7 calculates a required print time PT for the current print job on bases involving the calculated total vibration cycle number N. More specifically, the controller 7 calculates the print time PT depending on combination of the total vibration cycle number N calculated from image data of the print job, and a set of print parameters the duplex printing machine 1 has set up inclusive of transfer speeds VP of associated print sheets PA, and discharge speeds VI of aqueous ink 50 at associated nozzles.

At a step S2, the controller 7 operates for calculation to determine an interval of time ΔPT between previous and current print jobs, using a previous print completion time PTE stored in the HDD 54 and a current clock time CT.

Next, at a step S3, the controller 7 operates to determine whether or not the time interval ΔPT is equal to or longer than a threshold of interval time ThD stored in the HDD 54. If the time interval ΔPT is determined as being the interval time threshold ThD or more (Yes at the step S3), then the control flow goes to a step S5, where the controller 7 enters a designated process. On the other hand, if the time interval ΔPT is determined as being shorter than the interval time threshold ThD (No at the step S3), then the control flow goes to a step S4, where the controller 7 operates for calculation to add the previous print time PTA to the current print time PT, to determine a sum of them to be set as a new print time PT. To this point, it is noted that for short time intervals ΔPT exceeding a prescribed value, there is circulation of aqueous ink 50 repeated in consideration of properties of aqueous ink 50, such as viscosity. This is because of the concept in favor of regarding the previous print job as having been continued to the current print job, in order for failures in discharge of aqueous ink 50 to be suppressed safe against any interval of time ΔPT that is so short as being smaller than the threshold ThD, as a lapse of time after completion of the previous print job.

Next, at the step S5, the controller 7 operates to drive the circulation pump 23. This causes flux of aqueous ink 50 to flow, as shown in FIG. 2, in the flow direction indicated by arrows A, along the circulation route including the lower tank 22, circulation pump 23, degasser 24, filter 25, upper tank 26, and inkjet head 27, with associated ink lines 28 inclusive.

Next, at a step S6, the controller 7 operates to extract, from the threshold table Tb1 stored in the HDD 54, a threshold $Th_n$ of print time PT corresponding to an ink temperature interval $\Delta T_n$ covering an ink temperature T input from the temperature sensor 29, and set up the same. This is to hold out formation of bubbles tending to exert influences at different lengths of print time PT depending on the ink temperature T. In the example of threshold table Tb1 shown in FIG. 4, there is a threshold $Th_2$ of print time PT to be set for ink temperatures T belonging to an ink temperature interval $\Delta T_2 = T_2 \sim T_3$.

Next, at a step S7, the controller 7 operates to determine whether the print time PT is the threshold $Th_n$ or more, or not.

If the print time PT is determined as not being the threshold $Th_n$ or more (No at the step S7), then the control flow goes to a step S8, where the controller 7 operates to execute a normal image printing process without driving the degassing pump 24*a*. Here, the length of print time PT not being the threshold $Th_n$ or more refers to an extent of status of aqueous ink 50 to be developed within the short print time PT and substantially free of dissolved gases activated to form bubbles, needing no degassing.

Description is now made of actions for print to be executed in the normal image printing process (at the step S8) under control of the controller 7 through implements including the sheet feeder 2 to the sheet reverser 6. Initially, there is a non-printed print sheet PA being fed from any one of the feed racks 11 by associated feed rollers 12 along a feed route RS to the printer 3. The print sheet PA fed to the printer 3 is registered by the register rollers 15, and set in position on the belt transfer section 16. The print sheet PA on the belt transfer section 16 is carried at a normal print speed, when the print sheet PA has images printed thereon by droplets of aqueous ink 50 propelled out as necessary from inkjet heads 27 of ink circulation systems 17. The print speed is controlled by the controller 7 controlling revolution numbers of associated feed rollers 12, register rollers 15, and transfer rollers 32. The print sheet PA thus printed is still carried by the belt transfer section 16, to forward along the normal transfer route RC into the drying duct 31 of the sheet dryer 4.

At the sheet dryer 4, the print sheet PA is transferred by transfer rollers 32, while being guided by wall of the drying duct 31, to forward through a transfer space defined inside the drying duct 31 filled with heating air. The print sheet PA having been moist with aqueous ink 50 is thus dried in the drying duct 31. Then, the print sheet PA is forwarded outside the drying duct 31.

For one-side printing, the print sheet PA is transferred to the sheet discharger 5. At the sheet discharger 5, the print sheet PA is guided by the route selector 35, and carried by discharge rollers 36, to discharge onto the stacking rack 37.

For duplex printing, the print sheet PA is guided by the route selector 35 into the reversing route RR of the sheet reverser 6. At the sheet reverser 6, the print sheet PA is forwarded by associated reversing rollers 41 temporarily into the switchback section 43, while being guided by the flipper 42. After that, the print sheet PA being guided by the flipper 42 is returned from the switchback section 43, to re-feed to the printer 3 using associated reversing rollers 41.

At the printer 3, the print sheet PA is transferred by the belt transfer section 16 with the non-printed side of print sheet PA facing the inkjet heads 27, while having images printed on the non-printed side by inkjet heads 27. After that, the both-side printed print sheet PA is dried in the sheet dryer 4, and transferred to the sheet discharger 5.

Then, at a step S9, the controller 7 operates to determine whether or not the current print job is complete, on bases including the number of frames of image data to be printed and the number of printed sheets. If the printing is determined as being complete (Yes at the step S9), then the control flow goes to a step S16, where the controller 7 enters a designated process.

At the step S16, the controller 7 operates to stop the circulation pump 23. This stops circulation of aqueous ink 50 in the ink circulation system 17.

Next, at a step S17, the controller 7 operates to store in the HDD 54 a completion time PTE and print time PTA of the current print job, for use in a subsequent print job.

The printing process then goes to an end.

On the other hand, if the print time PT is determined as being the threshold $Th_n$ or more (Yes at the step S7), then the control flow goes to a step S10, where the controller 7 operates to drive the degassing pump 24*a*, to degas aqueous ink 50 circulating in the ink circulation system 17. Here, the length of print time PT being the threshold $Th_n$ or more refers to an extent of status of aqueous ink 50 to be developed within the long print time PT, having much dissolved gases forming bubbles, with high probabilities of failures in discharge of aqueous ink 50.

Next, at a step S11, the controller 7 operates to execute a turned-down image printing process. The turned-down image printing process refers to a process of printing images at a print speed turned down from, or slower than, a print speed in the normal image printing process. The turned-down image printing process affords to control dissipation of heat at the inkjet head 27, suppressing formation of bubbles by dissolved gases in aqueous ink 50. It is noted that the turned-down image printing process is similar in control action to the normal image printing process, excepting the print speed.

Next, at a step S12, the controller 7 operates to determine whether or not the time of degassing VT has elapsed a threshold ThV. If the degassing time VT is determined as having elapsed the threshold ThV (Yes at the step S12), then the control flow goes to a step S13, where the controller 7 operates to accelerate associated implements including feed rollers 12, register rollers 15, and transfer rollers 32, to start the normal image printing process at a normal print speed faster than the print speed in the turned-down image printing process. Here, the length of degassing time PT exceeding the threshold ThV refers to an extent of status of aqueous ink 50 degassed to remove much dissolved gasses therein, with low probabilities of failure in discharge of aqueous ink 50 to be achieved even in execution of the normal image printing process at the normal print speed.

Next, at a step S14, the controller 7 operates to check if the number of printed sheets has attained a preset sheet number, to determine whether or not the current print job is complete. If the print job is determined as being complete (Yes at the step S14), then the control flow goes to a step S15, where the controller 7 operates to stop the degassing pump 24*a*. This stops degassing aqueous ink 50.

In due course, the controller 7 operates to execute processes at the steps S16 and S17, so the printing process goes to an end.

(Performances of Duplex Printing Machine)

Description is now made of performances of the duplex printing machine 1.

According to the duplex printing machine 1 described, there is a controller 7 adapted for comparison between a print time PT and a threshold $Th_n$ to determine a degassing of aqueous ink 50 to be made or not. In other words, the controller 7 is adapted to predict a necessity of degassing to operate for driving a degassing pump 24*a* of a degasser 24. This affords to eliminate delays in initiation of a degassing that might have caused failures in discharge of aqueous ink 50 in a printing. Unlike techniques in the past, it affords to eliminate also issues in following an initiation of a printing to detect an amount of gases dissolved in aqueous ink 50, that might have lead to a delayed start of ink, resulting in a frequent failure in discharge of ink. Accordingly, there is an enhanced quality achieved in printed images, allowing for a suppressed occurrence of a forced shutdown in a printing.

According to the duplex printing machine 1, there is a controller 7 adapted for comparison between a print time PT and a threshold $Th_n$ to determine a degassing of aqueous ink 50 to be unnecessary, to operate for a printing without driving a degassing pump 24*a*. The duplex printing machine 1 thus allows for a reduced power consumption at the degassing pump 24*a*, with an implemented energy saving.

According to the duplex printing machine 1, there is a controller 7 adapted to have a threshold $Th_n$ of print time PT associated with an ink temperature T giving significant influences on failures of ink discharge, to thereby determine a degassing to be made or not. The duplex printing machine 1 according to the first embodiment thus affords, even in short print times PT, to eliminate failures in discharge of aqueous ink 50 due to increased heat dissipation at an inkjet head 27 with high ink temperatures T. Even in long print times PT on the contrary it affords to print images without driving a degassing pump 24*a*, subject to controlled heat dissipation at the inkjet head 27 with moderate ink temperatures T. The first embodiment thus permits implementing an energy saving duplex printing machine 1.

According to the duplex printing machine 1, there is a controller 7 adapted to work for a necessary degassing, to select a turned-down image printing process slower in print speed than a normal image printing process, with reduced tendencies for dissolved gases in ink to form bubbles. This permits the duplex printing machine 1 to start printing images without waiting a completion of degassing, thus allowing for a saved time before completion of the printing.

According to the duplex printing machine 1, there is a controller 7 adapted to work for a short interval of time between a previous clock of printing and a current clock of printing, to add a previous print time PT to a current print time PTA to set the sum as a print time PT, for use in determination of a degassing to be made or not. The duplex printing machine 1 is thus permitted to work, even in succession of different print jobs to be executed within a short while, to determine a necessity of degassing with a favorable precision, allowing for a suppressed failure in discharge of aqueous ink 50.

Second Embodiment

Figures 6, 7:
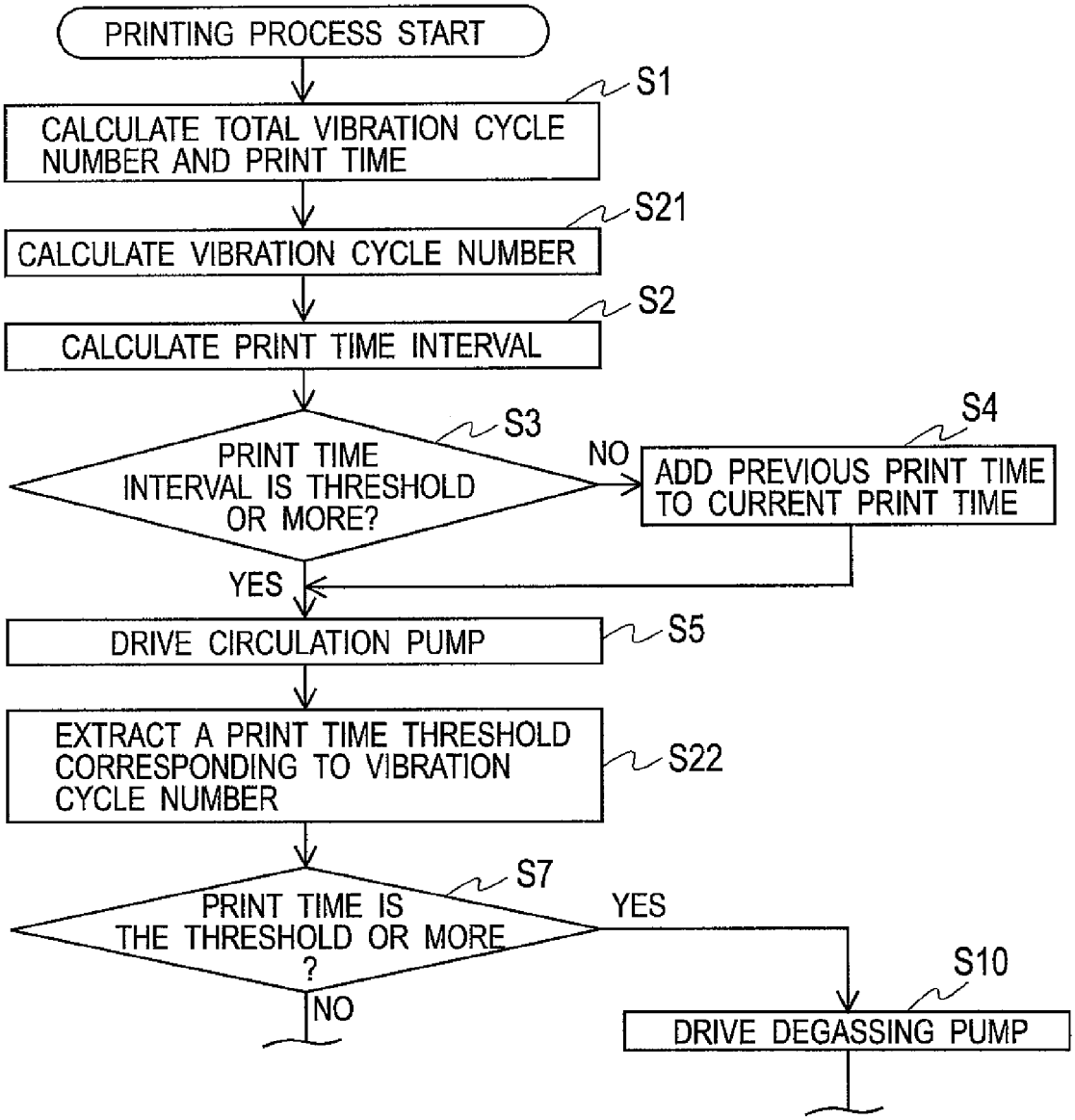
FIG. 6 is an explanatory flowchart of a printing process according to a second embodiment.
FIG. 7 is an example of threshold table listing print time thresholds associated with numbers of vibration cycles of piezoelectric elements.

Description is now made of a second embodiment according to a modification in printing process of the first embodiment. FIG. 6 is an explanatory flowchart of a printing process according to the second embodiment. FIG. 7 is an example of threshold table listing print time thresholds associated with numbers of vibration cycles of piezoelectric elements. With respect to the embodiment described, like elements are designated by like reference signs, omitting redundancy. Likewise, with respect to the embodiment described, like control steps are designated by like step numbers, omitting redundancy.

In the printing process according to the second embodiment, as shown in FIG. 6, there is a step S21 following a step S1, where the controller 7 operates for calculation to determine a vibration frequency f on bases including a set of image data of an input print job. As used herein, the vibration frequency f refers to the number of vibration cycles of the piezoelectric element set per unit time. The greater the vibration frequency f, the greater the heat dissipation of piezoelectric elements in the inkjet head 27 with an enhanced bubbling in aqueous ink 50. According to the second embodiment, in the HDD 54, there is stored as shown in FIG. 7 a threshold table Tb2 listing a number of domain intervals of vibration frequency f of piezoelectric elements $\Delta f_n$ (n=1, 2, . . . ) (=$f_1$~$f_2$, $f_2$~$f_3$, $f_3$~$f_4$, . . . ) and a number of thresholds of print time $Th_n$ (n=1, 2, . . . ) related thereto in a one-to-one corresponding manner.

After that, the controller 7 operates to execute designated processes at steps S2 to S5, like the first embodiment.

Next, at a step S22, the controller 7 operates to extract, from the threshold table Tb2 stored in the HDD 54, a threshold $Th_n$ of print time corresponding to a vibration frequency interval $\Delta f_n$ covering a vibration frequency f of piezoelectric elements calculated from an image data set, and set up the same. In the example of threshold table Tb2 shown in FIG. 7 according to the second embodiment, there is a threshold The of print time to be set for frequencies f belonging to a vibration frequency interval $\Delta f_2$=$f_2$~$f_3$.

After that, the controller 7 operates to execute designated processes at steps S7 et seq., like the first embodiment.

According to the second embodiment described, there is a controller 7 adapted to have a threshold $Th_n$ of print time PT associated with a vibration frequency f giving significant influences on failures of ink discharge, to thereby determine a degassing to be made or not. The duplex printing machine 1 according to the second embodiment thus affords, even in short print times PT, to eliminate failures in discharge of aqueous ink 50 due to increased heat dissipation at an inkjet head 27 with high frequencies f.

Even in long print times PT on the contrary it affords to print images without driving a degassing pump 24*a*, subject to controlled heat dissipation at the inkjet head 27 with moderate frequencies f. The second embodiment thus permits implementing an energy saving duplex printing machine 1.

Third Embodiment

Figures 8, 9:
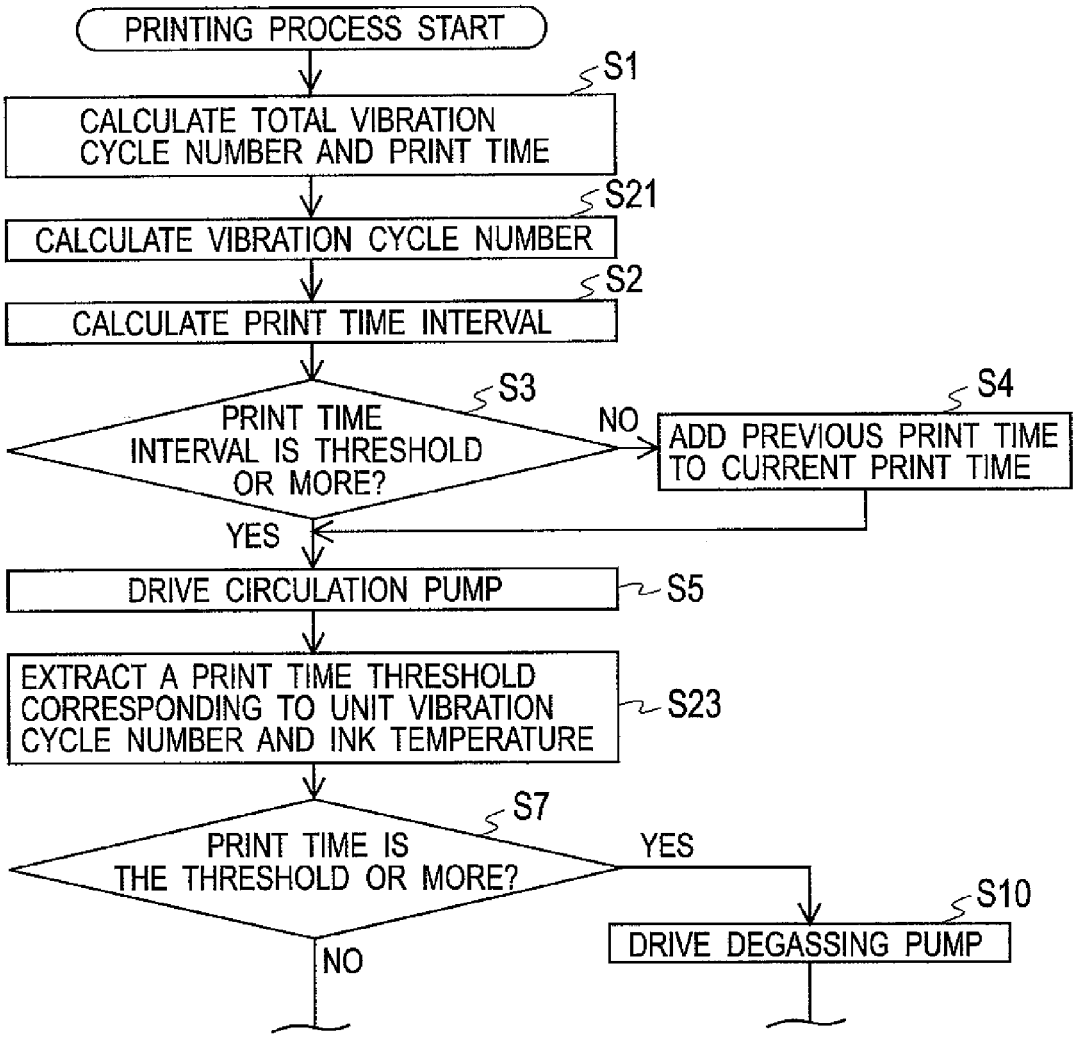
FIG. 8 is an explanatory flowchart of a printing process according to a third embodiment.
FIG. 9 is an example of threshold table listing print time thresholds associated with combinations of vibration cycles of piezoelectric elements and ink temperatures.

Description is now made of a third embodiment according to a modification in printing process of the embodiments described. FIG. 8 is an explanatory flowchart of a printing process according to the third embodiment. FIG. 9 is an example of threshold table listing print time thresholds associated with combinations of numbers of ink temperature intervals and numbers of vibration cycles of piezoelectric elements. According to the third embodiment, in the HDD 54, there is stored as shown in FIG. 9 a threshold table Tb3 listing a number of domain sections of ink temperature $\Delta T_n$ (n=1, 2, . . . ) (=$T_1$~$T_2$, $T_2$~$T_3$, $T_3$~$T_4$, . . . ) combined with a number of domain intervals of vibration frequency f of piezoelectric elements $\Delta f_n$ (n=1, 2, . . . ) (=$f_1$~$f_2$, $f_2$~$f_3$, $f_3$~$f_4$, . . . ), and a number of thresholds of print time $Th_n$ (n=1, 2, . . . ) related to the combinations in a one-to-one corresponding manner. With respect to the embodiments described, like elements are designated by like reference signs, omitting redundancy. Likewise, with respect to the embodiments described, like control steps are designated by like step numbers, omitting redundancy.

In the printing process according to the third embodiment, as shown in FIG. 8, the controller 7 operates to execute designated processes at steps S1, S21, and S2 to S5, like the second embodiment.

Next, at a step S23, the controller 7 operates to extract, from the threshold table Tb3 stored in the HDD 54, a threshold $Th_n$ of print time one-to-one corresponding to a combination of an ink temperature interval $\Delta T_n$ covering an ink temperature T input from the temperature sensor 29 and a vibration frequency interval $\Delta f_n$ covering a vibration frequency f of piezoelectric elements calculated from an image data set, and set up the same. In the example of threshold table Tb3 shown in FIG. 9 according to the third embodiment, there is a threshold $Th_2$ of print time to be set for a combination of any ink temperature T belonging to an ink temperature interval $\Delta T_2$=$T_2$~$T_3$ and any vibration frequency f belonging to a vibration frequency interval $\Delta f_2$=$f_2$~$f_3$.

After that, the controller 7 operates to execute designated processes at steps S7 et seq., like the first embodiment.

According to the third embodiment described, there is a controller 7 adapted to have a threshold $Th_n$ of print time PT associated with combination of an ink temperature and a vibration frequency f calculated from an image data set of a print job, to thereby determine a degassing to be made or not. The third second embodiment thus affords to enjoy effects of both the first embodiment and the second embodiment.

Although the present invention has been described by use of embodiments, the present invention should not be construed as being restrictive to the embodiments described. The scope of the present invention should be defined within the scope of appended claims as well as a scope equivalent to the scope of claims. There may be modifications in part of the embodiments described, as follows.

The embodiments described may have constituent elements thereof altered or changed as necessary in shape, value, material, or the like. The embodiments described may be combined as necessary.

In the embodiments described, the present invention has been applied to an aqueous ink-addressing inkjet type duplex printing machine. The present invention may well be applied to, among others, a solvent system ink-addressing inkjet type duplex printing machine and any of inkjet type printing machines of a one-side printing system or else.

In the embodiments described, the present invention has been applied to a printing machine provided with an ink circulation system. The present invention may well be applied to a printing machine adapted to supply ink to an inkjet head without circulating ink.

In the embodiments described, there has been use of a print time PT calculated from an image data set of a print job, for checking if it does or does not exceed a threshold $Th_n$ (n=1, 2, . . . ), to determine a necessity of driving a degassing pump. There may be use of any applicable method else to determine the necessity of driving a degassing pump. For instance, there may be use of a vibration frequency f calculated from an image data set of a print job, for checking if it does or does not exceed a threshold, to determine a necessity of driving a degassing pump. Or else, there may be use of a drive frequency fD of a belt transfer section 16, for checking if it does or does not exceed a threshold, to determine a necessity of driving a degassing pump. Here, the drive frequency fD refers to the number of lines to be printed per unit time in a process of printing line by line along a transfer direction of a print sheet. The drive frequency fD may be determined by calculation from a vibration frequency f calculated on bases including an image data set of a print job. For instance, there may be use of a drive frequency fD calculated on bases including a total vibration cycle number N of a piezoelectric element set, an ink discharge rate or speed VI, a total number of lines to be scanned at an inkjet head, and a print time.

There may be a controller 7 configured to determine a necessity of degassing every ink color. Preferably, this controller 7 should determine a necessity of degassing on bases including an ink temperature of a respective color of ink, a vibration frequency f or a total vibration cycle number N of a piezoelectric element set of a respective color of ink, a print ratio of a respective color of ink in an image data set, and the number of ink droplets per pixel of a respective color of ink.

In the embodiments described, there has been a threshold $Th_n$ of print time PT extracted from a threshold table Tb1, Tb2, or Tb3. There may be a controller 7 configured to calculate in advance a threshold of print time before an initiation of printing, on bases including an ink temperature T, a total vibration cycle number N, or a vibration frequency f.

The present application claims the benefit of priority under 35 U.S.C. §119 to Japanese Patent Application No. 2009-222918, filed on Sep. 28, 2009, and Japanese Patent Application No. 2010-212553, filed on Sep. 22, 2010, the entire content of which are incorporated herein by reference.

What is claimed is:

1. A printing machine comprising:

an inkjet head including a piezoelectric element set configured to vibrate to propel out droplets of ink;

a degasser configured to degas flux of ink to be supplied to the inkjet head;

a memory configured to store therein a threshold table having mutually associated a threshold set of a determination parameter preset for a determination on a degassing process and a domain set of a control parameter of a physical amount constituting a cause of bubble formation in ink; and a controller configured to control driving the degasser, the controller being adapted to calculate a value of the determination parameter from a set of image data of a print job, and operate as the value is equal to or greater than a threshold in the threshold table read out of the memory, to drive the degasser.

2. The printing machine according to claim 1, wherein the determination parameter comprises a print time calculated from the set of image data of the print job.

3. The printing machine according to claim 2, further comprising a temperature detector configured to detect an ink temperature at the inkjet head, wherein the control parameter comprises an ink temperature detected by the temperature detector, and the controller is adapted to identify, out of the domain set comprising a set of ink temperature intervals defined in the threshold table, an ink temperature interval the detected ink temperature belongs to, to use a threshold corresponding to the ink temperature interval, to make the determination on the degassing process.

4. The printing machine according to claim 2, wherein the control parameter comprises a vibration frequency of the piezoelectric element set calculated from the set of image data of the print job, and the controller is adapted to identify, out of the domain set comprising a set of vibration frequency intervals of the piezoelectric element set defined in the threshold table, a vibration frequency interval the calculated vibration frequency belongs to, to use a threshold corresponding to the vibration frequency interval, to make the determination on the degassing process.

5. The printing machine according to claim 2, further comprising a temperature detector configured to detect an ink temperature at the inkjet head, wherein the control parameter comprises a combination of an ink temperature detected by the temperature detector and, and a vibration frequency of the piezoelectric element set calculated from the set of image data of the print job, and the controller is adapted to identify, out of the domain set comprising a set of ink temperature intervals defined in the threshold table and a set of vibration frequency intervals of the piezoelectric element set defined in the threshold table, a combination of an ink temperature interval the detected ink temperature belongs to and a vibration frequency interval the calculated vibration frequency belongs to, to use a threshold corresponding to the combination of the ink temperature interval and the vibration frequency interval, to make the determination on the degassing process.

6. The printing machine according to claim 2, further comprising a transfer portion configured to transfer a print sheet, wherein the control parameter comprises a drive frequency of the transfer portion, and the controller is adapted to identify, out of the domain set comprising a set of drive frequency intervals of the transfer portion defined in the threshold table, a drive frequency interval a current value of the drive frequency belongs to, to use a threshold corresponding to the vibration frequency interval, to make the determination on the degassing process.

7. The printing machine according to claim 2, further comprising a transfer portion configured to transfer a print sheet, wherein the controller is adapted to drive the degasser, controlling the transfer portion to make a printing at a print speed slower than a print seed in a normal printing.

8. The printing machine according to claim 2, wherein the controller is adapted to operate as an interval of time from a previous print completion is shorter than a threshold, to set up as the print time a sum of a previous print time and a current print time.

* * * * *